US008893907B2

(12) United States Patent
Aneas

(10) Patent No.: US 8,893,907 B2
(45) Date of Patent: Nov. 25, 2014

(54) STOPPING DEVICE AND CONTAINER COMPRISING SUCH A DEVICE

(75) Inventor: Antoine Aneas, Menetrol (FR)

(73) Assignee: Biocorp Recherche et Developpement, Issoire (FR)

( * ) Notice: Subject to any disclaimer, the term of this patent is extended or adjusted under 35 U.S.C. 154(b) by 0 days.

(21) Appl. No.: 14/122,927

(22) PCT Filed: Jun. 5, 2012

(86) PCT No.: PCT/EP2012/060584

§ 371 (c)(1),
(2), (4) Date: Nov. 27, 2013

(87) PCT Pub. No.: WO2012/168230

PCT Pub. Date: Dec. 13, 2011

(65) Prior Publication Data

US 2014/0076896 A1 Mar. 20, 2014

(30) Foreign Application Priority Data

Jun. 6, 2011 (FR) ..... 11 54900

(51) Int. Cl.

| | |
|---|---|
| ***B65D 51/18*** | (2006.01) |
| ***B65D 51/24*** | (2006.01) |
| ***B65D 55/10*** | (2006.01) |
| ***B65D 41/58*** | (2006.01) |

(52) U.S. Cl.

CPC ..... *B65D 51/18* (2013.01); *B65D 2101/0023* (2013.01); *B65D 55/10* (2013.01); *B65D 41/58* (2013.01); *B65D 51/241* (2013.01)

USPC ..... 215/364; 215/355

(58) Field of Classification Search

CPC ..... B65D 39/0052; B65D 51/18; B65D 2251/0081; B65D 2251/0068; B65D 41/62; B65D 41/56; B65D 41/32; B65D 55/08; B65D 51/24

USPC ..... 215/364, 355, 228, 253, 252, 251, 250; 220/257.1, 256.1, 259.3, 266, 265

See application file for complete search history.

(56) References Cited

U.S. PATENT DOCUMENTS 2,941,689 A * 6/1960 Black ..... 220/522
4,372,456 A * 2/1983 Guala ..... 215/252

(Continued)

FOREIGN PATENT DOCUMENTS

DE 7426691 U 11/1974
FR 2281286 A1 3/1976

(Continued)

OTHER PUBLICATIONS

Search Report for Patent Application No. FR 11 54900, Jan. 19, 2012.
Search Report for Patent Application No. PCT/EP2012/060584.
PCT Written Opinion of the International Search Authority for International Application No. PCT/EP2012/060584 (Engish translation), Jul. 17, 2012.

* cited by examiner

*Primary Examiner* — Robert J Hicks
(74) *Attorney, Agent, or Firm* — Soquel Group LLC

(57) ABSTRACT

A stopping device for a container, comprising a circular stopper for closing the neck of the container, and a cap comprising a synthetic material that covers the neck and the stopper positioned in the neck, the cap comprising a cover and a ring for surrounding the stopper and the neck, the ring having a minimum inner diameter larger than the maximum diameter of the stopper, the ring and the cover being produced as a single component and connected by breakable bridges distributed over a circumference of the ring with an inner diameter that is larger than or equal to the maximum diameter of the stopper, and first locking tabs formed on the inside of the ring facing windows that are radially open towards the outside, and second locking tabs facing a closed part, each second tab formed between two first tabs, facing a strip of material separating windows.

17 Claims, 6 Drawing Sheets

(56) References Cited

U.S. PATENT DOCUMENTS

| | | | | |
|---|---|---|---|---|
| 4,423,820 | A | 1/1984 | Vangor | |
| 2006/0138072 | A1* | 6/2006 | Mishra | 215/274 |
| 2010/0089862 | A1* | 4/2010 | Schmitt | 215/249 |
| 2011/0303670 | A1* | 12/2011 | Baker | 220/257.1 |

FOREIGN PATENT DOCUMENTS

| | | | | |
|---|---|---|---|---|
| GB | 1522692 | A * | 8/1978 | B65D 41/32 |
| WO | 2004/094237 | A2 | 11/2004 | |

STOPPING DEVICE AND CONTAINER COMPRISING SUCH A DEVICE

CROSS-REFERENCES TO RELATED APPLICATIONS

This application claims priority benefit under 35 U.S.C. §371 to International Patent Application No. PCT/EP2012/060584 entitled STOPPING DEVICE AND CONTAINER COMPRISING SUCH A DEVICE, and filed by inventor Antoine Aneas on Jun. 5, 2012. International Patent Application No. PCT/EP2012/060584 claims priority to French Patent Application No. 11 54900, filed by inventor Antoine Aneas on Jun. 6, 2011.

FIELD OF THE INVENTION

The invention relates to a stopping device for a container, said device comprising a circular stopper provided to close the neck of the container, as well as a cap. The invention also relates to a container, for example a medicine bottle, equipped with such a stopping device.

BACKGROUND OF THE INVENTION

In the field of medicine containers, it is known to use a glass bottle to store an active ingredient in freeze-dried, powdered or liquid solution form. Such a bottle must be closed sealably so as to keep its contents under satisfactory storage conditions, until its use-by date. To hermetically seal such a bottle, it is known to use a stopping device that comprises a cylindrical stopper made from elastomer provided to close the neck of the bottle. The purpose of the stopper is to ensure the most complete sealing possible against gases, liquids and bacteria. It is known to combine such a stopper with a metal capsule with a membrane. The container is opened by tearing the metal capsule by pulling on the membrane. This may be problematic inasmuch as the metal capsule, which is most often made from aluminum, may break, which requires that it be removed by hand, resulting in a risk of cutting and, most often, the use of the small disassembly tool.

It is known from WO-A 94/04424 to use a plastic capsule that is intended to be immobilized around the stopper to isolate it from the outside. The multi-part structure of this known device makes it expensive. Furthermore, the capsule limits access to the stopper, which cannot be removed, unless the capsule is destroyed, which is not the normal operation of the device.

It is also known from FR-A-2 281 286 to provide a capsule made from plastic with breakable bridges connecting the lower and upper parts of the capsule. The inner diameter of the capsule is equal to that of a rubber stopper intended to be inserted into a neck of the container, which risks causing jamming of the stopper. Furthermore, the lower part of the capsule must be radially expanded to be immobilized on the neck, which is relatively imprecise and unreliable.

SUMMARY

The invention more particularly aims to resolve these drawbacks by proposing a new stopping device that is particularly simple and intuitive to use and that allows, inter alia, complete removal of the stopper for easy access to the contents of a container.

To that end, the invention relates to a stopping device for a container, said stopping device comprising a circular stopper provided to close the neck of the container as well as a cap made from a synthetic material able to cover both the neck and the stopper placed in that neck, said cap comprising a ring and being capable of surrounding the stopper and the neck in the mounted configuration and being provided with means for locking on the neck, as well as with a cover. The ring and the cover are made as a single component and connected by breakable bridges. The stopping device is characterized in that the ring has a minimum inner diameter strictly larger than the maximum diameter of the stopper, in that the circumference of the ring on which the breakable bridges are distributed has an inner diameter strictly larger than the maximum diameter of the stopper, and in that the means for locking the ring on the neck comprise first locking tabs formed on the inside of the ring across from windows that are radially open to the outside of the ring, as well as second locking tabs formed on the inside of the ring across from a closed part of the ring, whereas each second locking tab is formed, on the circumference of the ring, between two first locking tabs, facing a strip of material separating windows which are facing the first locking tabs.

Owing to the invention, when the cap is placed on the neck of a container, said cap protects, in particular using its cover, the stopper against outside attacks, in particular against any risk of untimely removal. When the contents of the container need to be accessed, one need only break the bridges to access the stopper, which can be removed easily, since the cap does not hinder access to its periphery, once the cover is separated from the ring. This breaking of the bridges being irreversible, it is easily detectable and indicates any interference with the contents of the container. Furthermore, the structure of the locking means ensures reliable and lasting immobilization of the cap on the neck of a container, while being compatible with the connection of the cover with the ring using the breakable bridges.

According to advantageous but optional aspects of the invention, such a stopping device may incorporate one or more of the following features, considered in any technically allowable combination:

- The ratio of the value of the minimum inner diameter of the ring to the value of the maximum diameter of the stopper is comprised between 1.01 and 1.05, preferably between 1.02 and 1.04, while the inner diameter of the circumference of the bridges is equal to the minimum inner diameter of the ring.
- The value of the inner diameter of the circumference of the bridges is greater than or equal to the value of the minimum inner diameter of the ring.
- Each bridge has a favored break zone that is closer to the attachment zone of the bridge on the ring than the attachment zone of the bridge on the cover.
- Each bridge is in the form of a trapezoid with its smallest base at one edge of a skirt of the ring.
- Each bridge is configured to be broken by a shearing force resulting from the rotation, around a central axis of the device, of the cover relative to the ring or by a pulling force during tilting of the cover relative to the ring.
- Once the ring is placed on the neck of the container, said ring cannot be disassembled, unless it is at least partially destroyed.
- The locking means are formed in two separate angular sectors of the ring.
- The separate angular sectors are aligned, each in a direction parallel to the central axis of the device, with a window formed in an end wall of the cover, along an inner radial surface of an outer skirt of the cover.
- The ring is provided with an identification mark. In that case, the identification mark is preferably affixed on an outer radial surface of the ring, between the two separate angular sectors in which the locking means are formed. The identification mark is situated away from the open windows.

When the ring and the stopper are placed on the neck of the container in a configuration where the stopper closes the neck and where the ring surrounds the neck and the stopper, the surface of the stopper opposite the neck extends beyond a surface of the neck opposite the bottom of the container, over a distance greater than the distance by which the ring extends beyond the aforementioned surface of the neck. In other words, the stopper protrudes more than the ring above the neck, which facilitates access to that stopper when one wishes to move it, whereas the ring remains placed around the neck.

The invention also relates to a container, in particular a medicine bottle, that is equipped with a stopping device as described above.

In such a container, it is possible to provide that the minimum inner diameter of the ring has a value strictly greater than the value of the maximum diameter of the neck of the container.

BRIEF DESCRIPTION OF THE DRAWINGS

The invention will be better understood and other advantages thereof will appear more clearly upon reading the following description of one embodiment of a stopping device and a container according to its principle, provided solely as an example and done in reference to the appended drawings, in which.

DETAILED DESCRIPTION

Figure 1:
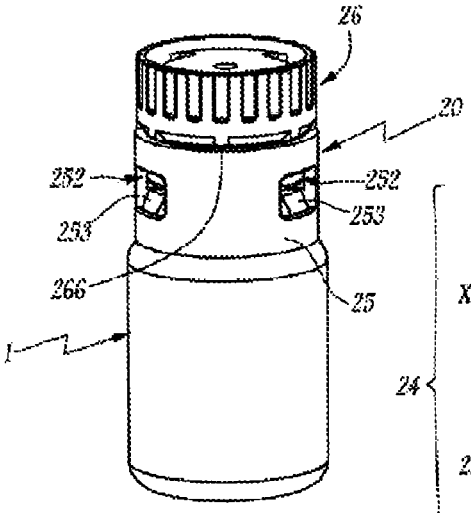
FIG. 1 is a perspective view of a medicine bottle according to the invention equipped with a stopping device according to the invention.

The bottle 1 shown in the figures is made from glass and comprises a bottleneck 11 defined by a neck 12 having an outer collar 13. X1 denotes the axis of symmetry of the bottle 1, which is also a central axis of the neck 12 and the collar 13. The bottom of the bottle 1 opposite the neck 11 is denoted 14. Reference 132 and 134 denote the surfaces of the collar 13 oriented across from the bottom 14 and toward said bottom, respectively. In other words, the surfaces 132 and 134 respectively make up the lower and upper surfaces of the collar 13 when the bottle 1 rests by its bottom 14 on a horizontal planar surface.

Figures 4, 5, 6:
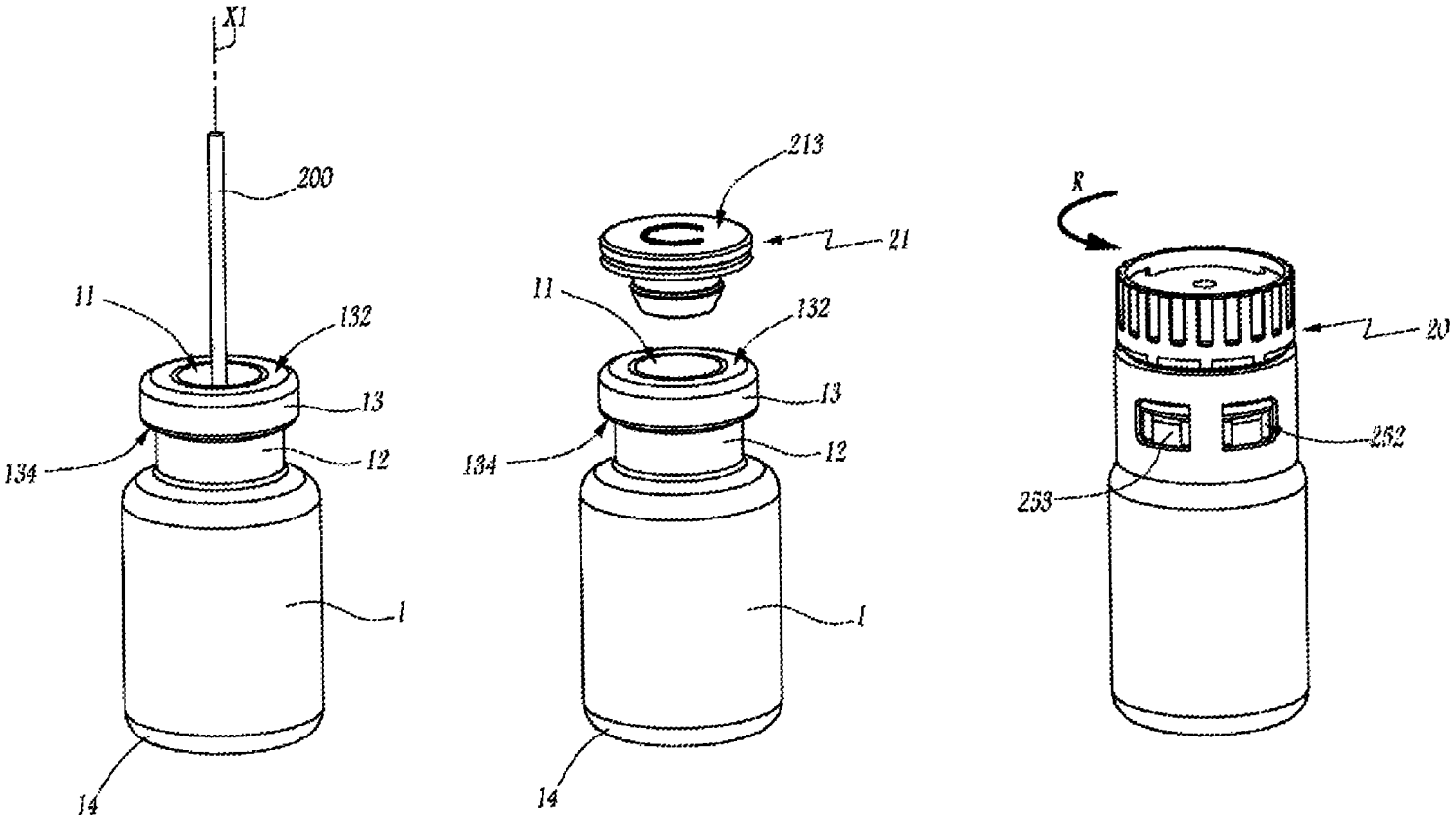
FIGS. 4 to 9 show several successive steps in the use of the bottle of FIGS. 1 to 3.

When the bottle 1 is to be filled, a pipette 200 is inserted therein, through its bottleneck 11, as shown in FIG. 4. When a predetermined quantity of product has been inserted into the bottle 1, the pipette 200 is removed and a stopping device 20 is placed on the neck 12. The device 20 comprises an elastomer stopper 21 with a shape suitable for being partially inserted into the bottleneck 11, while resting on the face 132 of the collar 13. The stopper 21 is a single component and comprises a disc-shaped plate 211 intended to rest on the surface 132 as well as a hollow rod 212 intended to penetrate the bottleneck 11. Once placed on the neck 12, the stopper 21 isolates the contents of the bottle 1 from the outside. X21 denotes a central axis of symmetry of the stopper 21, and D21 denotes the diameter of the plate 211, which is the maximum diameter of the stopper 21. In the configuration where the stopper 21 is assembled on the bottle 1, the axes X1 and X21 are superimposed.

The device 20 also comprises a cap 24 intended to cover and isolate the stopper 21 and the neck 12 in the closed configuration of the stopping device.

The cap 24 comprises a ring 25 and a cover 26 that are molded together and form a single component as cap 24. In other words, continuous material exists between the elements 25 and 26, within the cap 24.

The ring 25 is provided with two sets of three locking teeth below the surface 134 of the collar 13.

Reference 251 denotes an outer peripheral skirt of the ring 25. This skirt is pierced with two sets of two windows 252 that cross radially through it between the inner radial surface 251A and the outer radial surface 251B of the skirt 251. Facing each window 252, a deformable tab 253 is formed on the inside of the ring 25, i.e., on the side of the surface 251A. Each tab 253 defines a locking surface 253A intended to bear against the surface 134 when the cap 24 is placed around the neck 12 of the bottle 1.

Reference 254 denotes a strip of material belonging to the skirt 25 and positioned between two adjacent windows 252. On the inside, i.e., on the side of the surface 251A, each strip 254 is provided with a locking tab 255 whereof the upper surface 255A constitutes a locking surface against the surface 134 of the collar 13 in that configuration with the cap 24 mounted around the neck 12.

The difference between the tabs 253 and the tabs 255 is that the tabs 253 can pivot more easily, i.e., under the effect of a lower intensity force, than the tab 255 relative to the skirt 251. In fact, since they are located at the windows 252, the tabs 253 are connected to the skirt 251 only at their lower edge 253B, which is across from the surface 253 and is turned toward the lower edge 251C of the skirt 251, which is across from the cover 26. On another side, each tab 255 is secured to the adjacent strip 254 over the majority of its height, such that it has a lower risk of deforming under the effect of the force exerted on its upper structure 255A.

X24 denotes the central axis of the cap 24, said axis being superimposed with the axes X1 and X21 in the configuration where the device 20 is mounted on the bottle 1.

Figure 12:
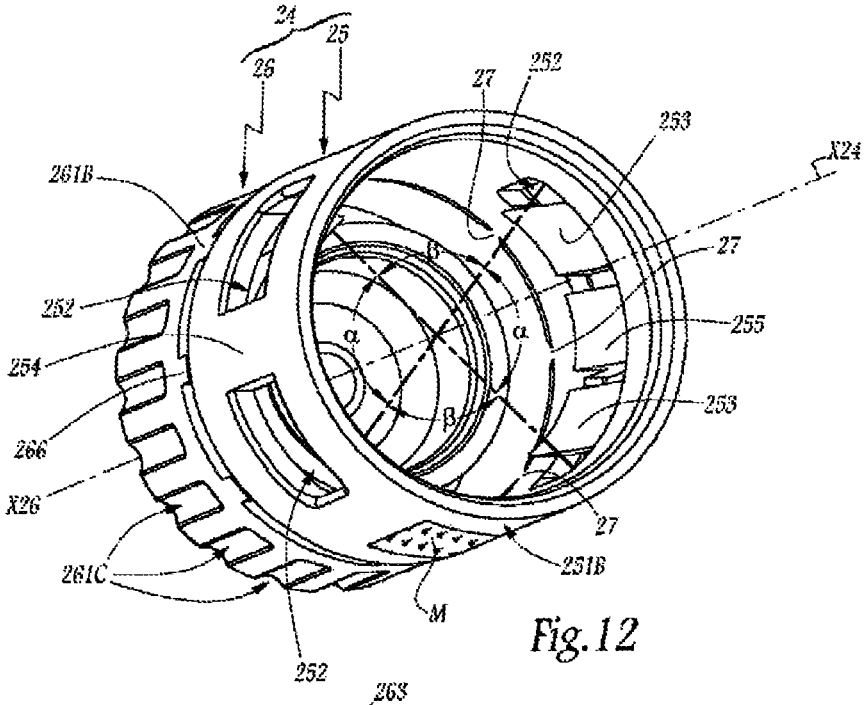

As emerges more particularly from FIG. 12, the teeth 253 and 255 are formed on two angular sectors with an apical angle $\alpha$ of approximately 90° relative to the axis X24. These two angular sectors, in which the tabs 253 and 255 are formed, are opposite and separated by angular sectors with an apical angle $\beta$ where the skirt 251 is solid, its outer radial surface 251B being a cylinder segment with a straight generatrix and an arc of circle section.

The tabs 253 and 255 constitute means for locking the cap 24 on the neck 12 of the bottle 1. The geometry of the skirt 251 and its tabs 253 and 255 is compatible with placement of the cap 24 on the neck 12, after placing the stopper 21, through a thrust force aligned on the axes X1, X21 and X24, which are then combined and oriented toward the bottom 14 of the bottle 1. During this placement, the tabs 253 and 255 gradually deform, lastly, as they pass by the collar 13.

The cover 26 comprises an outer skirt 261 whereof the outer radial surface 261B is serrated, which facilitates the transmission of a rotational torque between a users fingers and said cover. Reference 261C denotes the serrations formed on the surface 261B. X26 denotes the central axis of the cover 26, which is combined with the axis X24 when the parts 25 and 26 of the cap are secured. The cover 26 is provided with an end wall 262 perpendicular to the axis X26 and which is connected to the skirt 261 on two bridges 261D that each extend over an angular sector with an apical angle γ strictly smaller than 180° relative to the axis X26, preferably approximately 90°. Two curved windows 263 are thus formed along the inner radial surface 261A of the skirt 261, between said skirt and the wall 2, outside the angular sectors with apical angle γ.

The windows 263 are each aligned, in a direction parallel to the axes X24 and X26, with a set of locking tabs 253-254. In other words, the windows 263 are across from angular sectors with an apical angle α. This makes it possible to mold the surfaces 253A and 255A using one or more pins passing through the windows 263.

Apart from its junction zones with the skirt 261, the wall 262 is circular and centered on the axis X26. On the side of the ring 25, the wall 262 extends by an annular skirt 264 concentric to the skirt 261 and that is intended to press the plate 211 of the stopper 21 against the surface 132 of the collar 13 when the device 20 is in place on the neck 12 of the bottle 1.

The elements 25 and 26 of the cap 24 are made by breakable bridges 27 that create a material continuity between said elements 25 and 26 and that are in the shape of a trapezoid, with their smallest base 271 at the upper edge 251D of the skirt 251, i.e., the edge of said skirt turned toward the cover 26.

Figure 3:
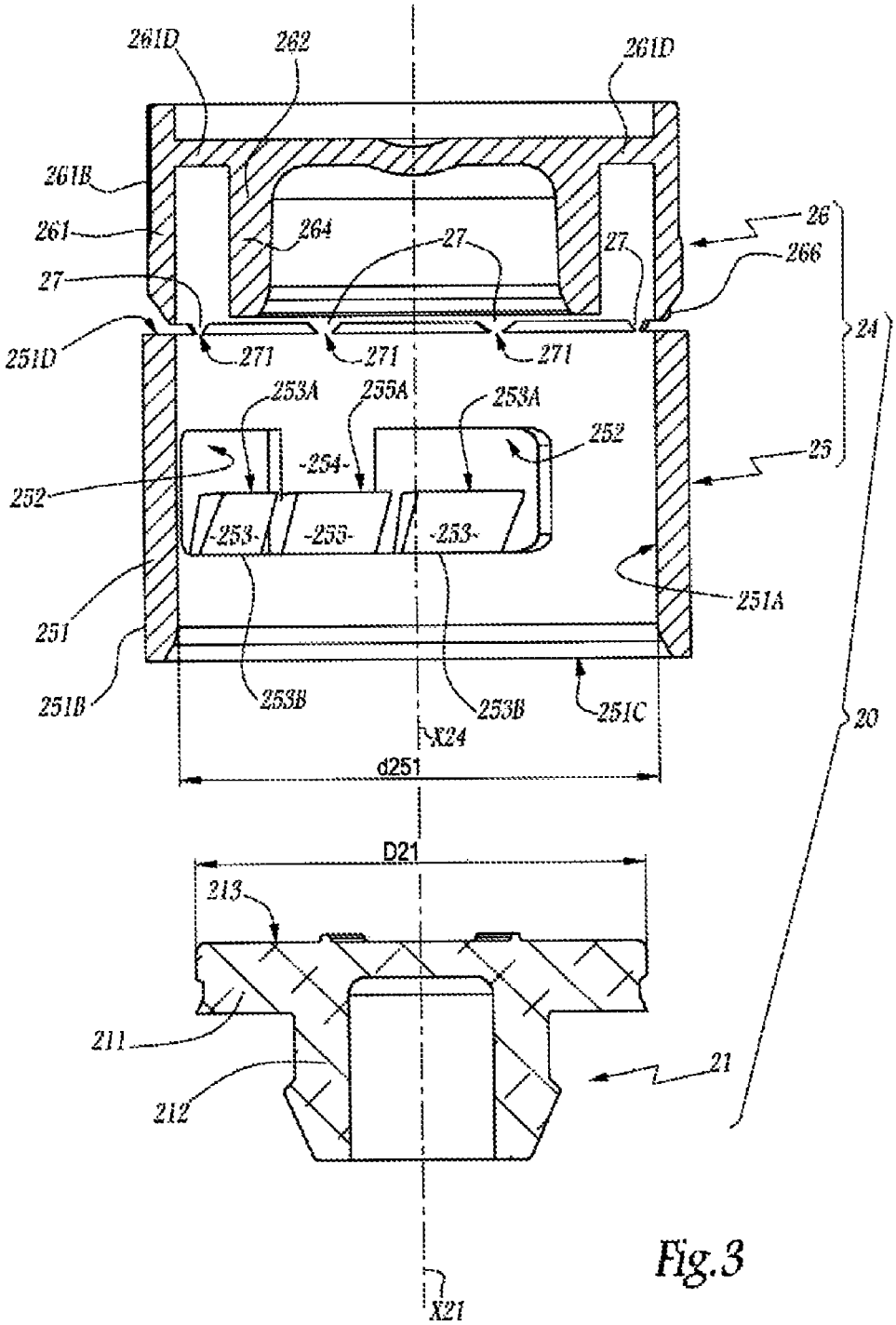
FIG. 3 is a still more enlarged axial cross-section, but in another cutting plane, of the stopping device used with the container of FIGS. 1 and 2, in an exploded configuration.

Reference d251 denotes the inner diameter of the skirt 251. This diameter makes up the minimum inner diameter of the ring 25. As shown in particular in FIG. 3, this diameter is strictly greater than the maximum diameter $D_{21}$ of the stopper 21. Thus, the skirt 251 does not interfere with the stopper 21 during placement of the cap 24 on the bottle 1.

There are eight bridges 27 regularly distributed on the edge 251D, such that they are located on a circumference of the ring 25 whereof the inner diameter d27 is greater than or equal to the diameter d251. In the example shown in the figures, the diameters d27 and d251 are equal.

In practice, the ratio d251/D21 may be comprised between 1.01 and 1.05, preferably between 1.02 and 1.04.

Furthermore, the value of the diameter d251 is chosen to be strictly greater than the outer diameter D13 of the collar 13, which is the maximum diameter of the neck 12. This allows the ring 25 to be mounted on the neck 12 without radial expansion of the skirt 251. In practice, the ratio d251/D13 is chosen between 1.005 and 1.01, preferably equal to 1.0075.

The dimensions of the bridges 27, in particular their section at their respective small bases 271, are chosen such that it is possible to break said bridges at those small bases using a torque driving the cover 26 around the axis X1, that torque in turn causing the cover 26 to rotate as shown by arrow R in FIG. 6.

The bridges may also be broken by a pulling force when the user tilts the cover 26 relative to the ring 25, around an orthoradial axis relative to the axis X24.

At the level of each bridge 27 and radially on the outside thereof, the cover 26 is provided with a rib 266 that extends toward the ring 25 from the skirt 261. These ribs 266 make it possible to transmit an axial thrust force to the ring 25 oriented toward the bottom 14 and applied on the cover 26, during mounting of the cap 24 on the bottle 1. In fact, in those cases, the bridges 27 deform elastically, to the point that the ribs 266 bear on the edge 251D.

Figure 7:
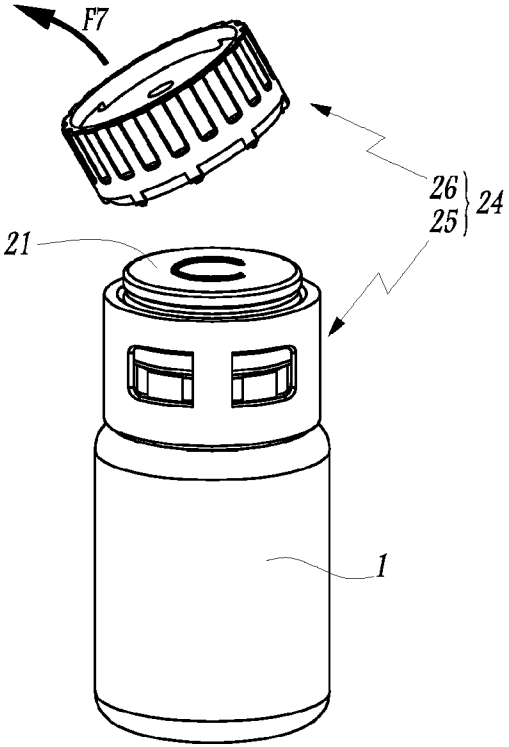
Figure 11:
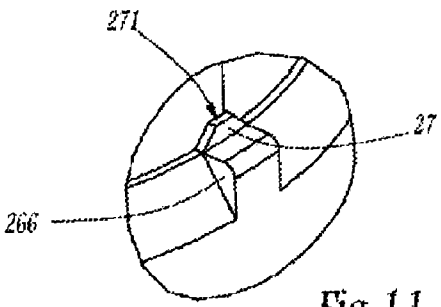
FIG. 11 is an enlarged view of detail XI of FIG. 10, FIGS. 12 and 13 are perspective views, from two different angles, of the cap of the stopping device according to the invention before separation of its ring and cover.
Figure 10:
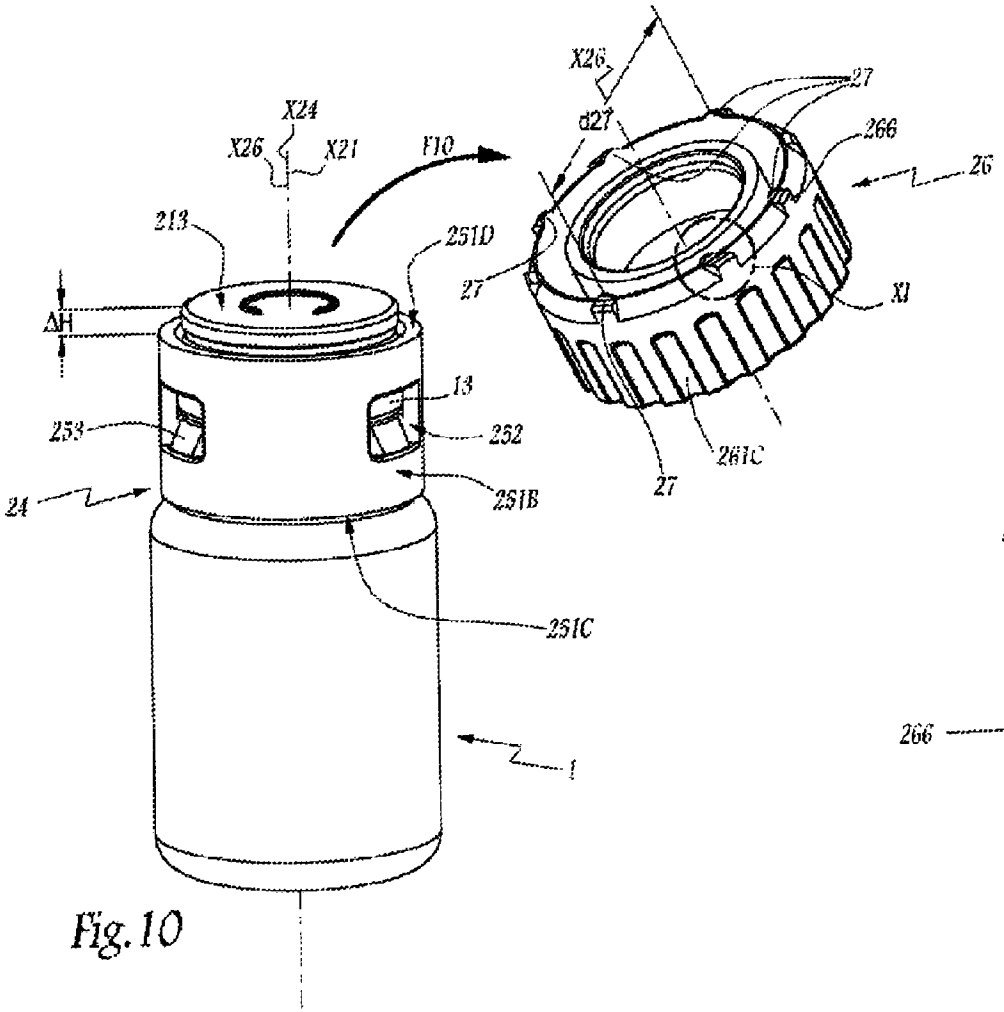
FIG. 10 is an enlarged view of the bottle in the configuration of FIG. 7, the cover being shown in the upright configuration.

When the bridges 27 are broken, it is possible to separate the cover 26 from the ring 25, as shown by the arrows F7 and F10 in FIGS. 7 and 10. Since the diameter d27 is strictly greater than the diameter D21, the part of the bridges 27 that may remain on the ring 25 does not hinder access to the stopper 21, or the removal of said stopper. In light of the location of the small bases 271, which constitute favored breaks zones for the bridges 27, in contact with the edge 251D, the bridges remain, for the most part, on the cover 26, such that the upper edge 251D of the skirt 251 is free and the outline of the small bases 271 on that edge does not hinder subsequent handling of the stopper 21.

The handling of the cover 26 does not move the ring 24 relative to the bottle 1, since it is kept firmly in position on the neck 12 using the locking tabs 253 and 255. In fact, the bearing force of the plate 211 on the surface 132 exerted by the skirt 264 results in tensioning the stopper device 20 on either side of the collar 13, along the axis X1. In other words, the plate 211 of the stopper 21 and the surfaces 253A and 255A of the locking tabs 25 exert a compression force on the collar 13, which is more rigid than the stopping device 20, which results in tensioning the component parts of that device. This causes firm bearing of the surfaces 253A and 255A of the tabs 253 and 255 against the surface 134, which limits the risks of rotation of the ring 25 under the effect of the torque exerted by a user on the cover 26 during removal thereof.

Figure 2:
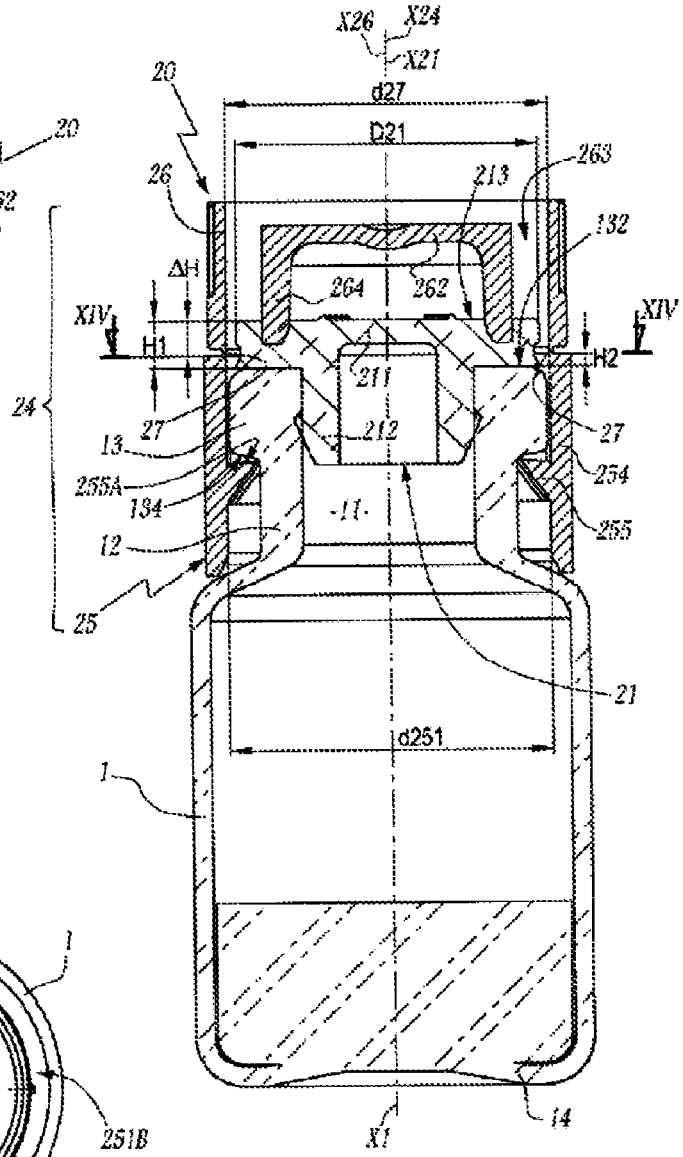
FIG. 2 is an enlarged axial cross-section of the device of FIG. 1.
Figure 14:
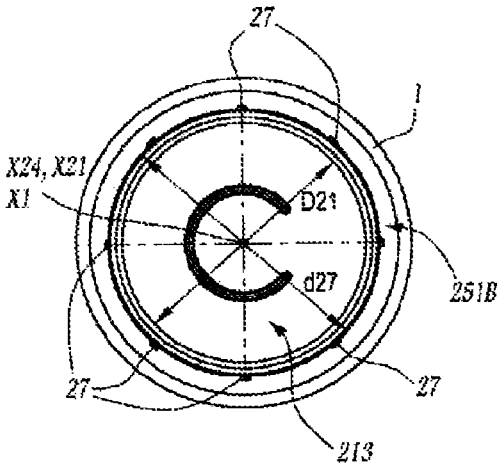
FIG. 14 is a cross-section along line XIV-XIV in FIG. 2.

As more particularly shown in FIGS. 2 and 10, when the cover 21 is placed on the neck 12, its upper surface 213, i.e., the surface of the plate 211 opposite the rod 212, passes beyond the surface 132 over a height H1 measured parallel to the axis X1. Furthermore, the edge 251D also extends above the surface 132 over a height H2 whereof the value is smaller than the height H1. This results in a height shift ΔH along the axis X1 between the surfaces 213 and 251D, said height shift facilitating access to the stopper 211 by one side of the ring 25 when said stopper needs to be removed, from the configuration of FIGS. 7 and 10.

Figure 9:
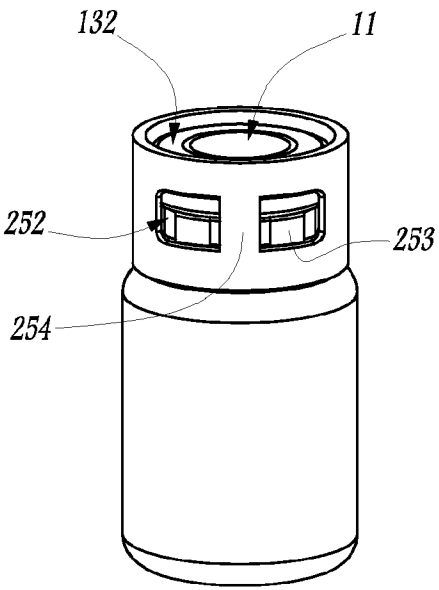
Figure 8:
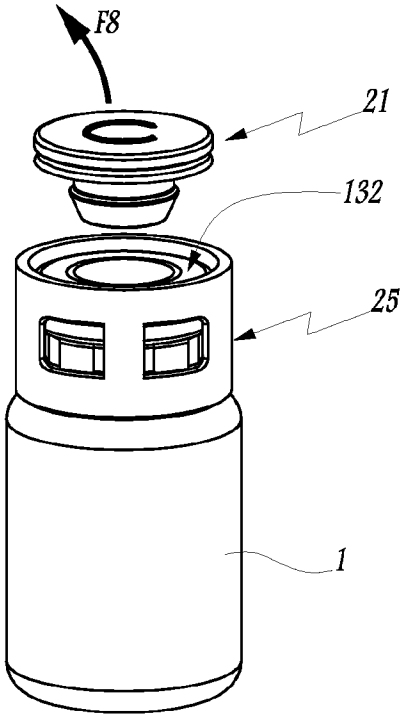

Once said stopper has been removed in the direction of the arrow F8 in FIG. 8, the device is in the configuration of FIG. 9, where the ring 25 does not hinder access to the content of the bottle 1, while remaining placed on the neck 12.

Figure 13:
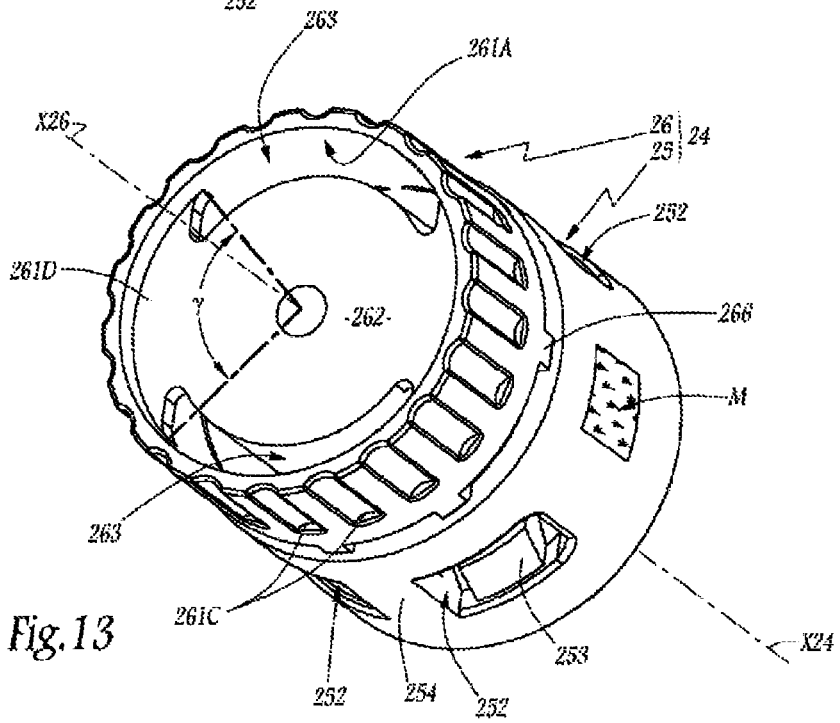

According to one aspect of the invention shown only in FIGS. 12 and 13, an identification mark M is affixed on the surface 251B. Such a mark may be obtained by etching, or by printing, for example using the DATA MATRIX format. The positioning of the mark M on the ring 25 causes that mark to remain accessible, for reading by a suitable device, including after removal of the cover 26, i.e., throughout the entire usage period of the bottle 1.

This must be compared to the fact that the ring 25 is provided to remain in place on the bottle 1 indefinitely after it has been assembled. In other words, the ring 24 cannot be disassembled from the bottle 1, unless it is partially destroyed, in particular by cutting its tabs 253 and 255, its strips 254 or its skirt 251.

In practice, the mark M is formed on a portion of the surface 251B situated in an angular sector with apical angle β, i.e., away from the windows 252.

Alternatively, the mark may be replaced by a particular pigmentation of the cap 24, each color corresponding to a product type present in a bottle. The identification of the contents of the bottle is made easier, since the ring thus colored remains on the bottle, including after the cover 26 has been removed.

The material used to mold the cap 24 may be a polyoxyethylene or a polypropylene, and is chosen to cause a clean break at the small bases 271 of the bridges 27.

According to one alternative of the invention that is not shown, the favored breaks zones of the bridges 27 may be formed not in contact with the edge 251D, but at a small axial distance therefrom. In practice, the axial distance between these favored breaks zones and the edge 251D is smaller than the axial distance between said favored breaks zones and the fastening zones of the bridges 27 on the skirt 261. This relationship is also verified in the case shown in the figures since, in that case, the axial distance between the small bases 271 and the edge 251D is zero, therefore smaller than the axial height of the bridges.

The invention claimed is:

1. A stopping device for a container, said stopping device comprising a circular stopper provided to close a neck of a container as well as a cap made from a synthetic material able to cover both the neck and the stopper placed in that neck, said cap comprising a ring and being capable of surrounding the stopper and the neck in the mounted configuration and being provided with means for locking on the neck, as well as with a cover, whereas the ring and the cover are made as a single component and connected by breakable bridges distributed over a circumference of the ring, wherein:

the ring has a minimum inner diameter strictly larger than the maximum diameter of the stopper, the circumference of the ring on which the breakable bridges are distributed has an inner diameter strictly larger than the maximum diameter of the stopper, the means for locking the ring comprise:

first locking tabs formed on the inside of the ring across from windows that are radially open to the outside of the ring, second locking tabs formed on the inside of the ring across from a closed part of the ring, and each second locking tab is formed, on the circumference of the ring, between two first locking tabs, facing a strip of material separating the windows which are facing the first locking tabs.

2. The device according to claim 1, wherein the ratio of the value of the minimum inner diameter of the ring to the value of the maximum diameter of the stopper is comprised between 1.01 and 1.05, while the inner diameter of the circumference of the bridges is equal to the minimum inner diameter of the ring.

3. The device according to claim 1, wherein the value of the inner diameter of the circumference of the bridges is greater than or equal to the value of the minimum inner diameter of the ring.

4. The device according to claim 1, wherein each bridge has a favored break zone that is closer to an attachment zone of the bridge on the ring than an attachment zone of the bridge on the cover.

5. The device according to claim 4, wherein each bridge is in the form of a trapezoid with its smallest base at one edge of a skirt of the ring.

6. The device according to claim 1, wherein each bridge is configured to be broken by a shearing force resulting from the rotation, around a central axis of the device, of the cover relative to the ring or by a pulling force during tilting of the cover relative to the ring.

7. The device according to claim 1, wherein once the ring is placed on the neck of the container, said ring cannot be disassembled, unless it is at least partially destroyed.

8. The device according to claim 1, wherein the locking means are formed in two separate angular sectors of the ring.

9. The device according to claim 8, wherein the separate angular sectors are aligned, each in a direction parallel to a central axis of the device, with a window formed in an end wall of the cover, along an inner radial surface of an outer skirt of the cover.

10. The device according to claim 1, wherein the ring is provided with an identification mark.

11. The device according to claim 10, wherein the locking means are formed in two separate angular sectors of the ring and wherein the identification mark is affixed on an outer radial surface of the ring, between the two separate angular sectors.

12. The device according to claim 10, wherein the identification mark is situated away from the windows radially open to the outside of the ring.

13. The device according to claim 1, wherein when the ring and the stopper are placed on the neck of the container in a configuration where the stopper closes the neck and where the ring surrounds the neck and the stopper, the surface of the stopper opposite the neck extends beyond a surface of the neck opposite the bottom of the container, over a distance greater than the distance by which the ring extends beyond the aforementioned surface of the neck.

14. A container and the stopping device of claim 1.

15. The container and stopping device according to claim 14, wherein the minimum inner diameter of the ring has a value strictly greater than the value of the maximum diameter of the neck of the container.

16. The device according to claim 2, wherein the ratio of the value of the minimum inner diameter of the ring to the value of the maximum diameter of the stopper is comprised between 1.02 and 1.04.

17. The container and stopping device according to claim 14, wherein said container comprises a medicine bottle.

* * * * *